US005154365A

United States Patent [19]

Schmitt

[11] Patent Number: 5,154,365

[45] Date of Patent: Oct. 13, 1992

[54] BOBBIN HOLDER FOR A HIGH SPEED TEXTILE SPINDLE

[75] Inventor: Günther Schmitt, Hammelburg, Fed. Rep. of Germany

[73] Assignee: FAG Kugelfischer Georg Schafer KGaA, Fed. Rep. of Germany

[21] Appl. No.: 781,736

[22] Filed: Oct. 23, 1991

[30] Foreign Application Priority Data

Nov. 29, 1990 [DE] Fed. Rep. of Germany ... 9016205[U]

[51] Int. Cl.[5] ..... B65H 54/54

[52] U.S. Cl. ..... 242/46.2; 242/46.6

[58] Field of Search ..... 242/46.2, 46.21, 46.3, 242/46.4, 46.5, 46.6, 129.7, 129.71, 130, 134, 141; 57/129, 130

[56] References Cited

U.S. PATENT DOCUMENTS

| | | | |
|---|---|---|---|
| 3,306,543 | 2/1967 | Beerli | 242/46.6 |
| 3,724,770 | 4/1973 | Carroll | 242/46.6 |
| 4,157,006 | 6/1979 | Guillot | 242/46.2 X |
| 4,726,179 | 2/1988 | Smith et al. | 242/46.6 X |

FOREIGN PATENT DOCUMENTS 7409733 5/1975 Fed. Rep. of Germany .

*Primary Examiner*—Stanley N. Gilreath

*Attorney, Agent, or Firm*—Ostrolenk, Faber, Gerb & Soffen

[57] ABSTRACT

A bobbin holder for a textile spindle. A spindle having an upper part with opposite double flat surfaces and with a bottom surface. An upper adapter for placement around the upper part of the spindle, the adapter having a recess in it adapted to the shape of the upper part of the spindle, such that at one rotation orientation, the upper part of the spindle core is aligned with and is in the adapter recess and at other rotation orientations, the upper part of the spindle is out of the adapter recess. There is an upper adapter with a conically tapered bobbin receiver and an opposed lower adapter also with a conically tapered bobbin receiver which are both conically tapered to be received in the opening in the bobbin. A spring in one of the top and the bottom adapters biases the respective conical receiver toward the other conical receiver for securing the bobbin between the two conical receivers.

8 Claims, 2 Drawing Sheets

BOBBIN HOLDER FOR A HIGH SPEED TEXTILE SPINDLE

BACKGROUND OF THE INVENTION

The present invention relates to a bobbin holder for high speed textile spindles.

A large number of types of bobbin holders are known which have a greater or lesser number of defects either with respect to handling, manufacture, safety or else of an economic nature.

Federal Republic of Germany Utility Model 7409733, published May 28, 19875 describes a textile bobbin holder having a bayonet lock base. A danger has been noted in practice that the retaining web on the core of the spindle of the bobbin holder sometimes breaks. Further, cylindrical pins in the bobbin adapter rest merely linearly in the bayonet receiver. This leads to vibrations which loosen the pins, and the adapter is released. In this connection, the bobbin also is loosened resulting in consequences of that are unforeseeable.

SUMMARY OF THE INVENTION

The object of the present invention is to provide a functional bobbin holder which is reliable in handling, is economically feasible and does not have the above indicated defects.

The present invention relates to a bobbin holder which relies on two opposed spaced apart, conical receiving means located on adapters on the spindle. The tapered narrow ends of the adapter receiving means are inserted into the open opposite ends of the tubular bobbin and their tapered shapes wedge the adapters against the bobbin securely and also self adapt the adapters to different size end openings into the tubular bobbin. The upper adapter is the adapter that is usually removable from the spindle, enabling installation of the bobbin from the top of the spindle.

The engagement force between the removable adapter and the spindle is advantageously distributed over a large surface area. Yet, the engagement between the adapter and the spindle acts like a bayonet lock to optimally secure the bobbin. This is accomplished by providing a large surface area of contact between the upper adapter and the spindle. There is a recess in the upper end of the adapter to receive the enlarged top end of the spindle and particularly to engage the large surface area sidewalls and the bottom surface of the spindle top end. This arrangement is of a bayonet lock type and it prevents relative rotation of the spindle and the adapter.

A spring acts on at least one of the adapters to bias the respective conical receiver toward the bobbin and the other conical receiver to securely hold the bobbin and to compensate for different bobbin lengths. The spring can be in either the removable upper adapter or in the nonremovable adapter which is installed at the lower end of the spindle.

Other objects and features of the invention are explained below with reference to examples shown in the drawings.

DESCRIPTION OF THE PREFERRED EMBODIMENTS

Figure 1:
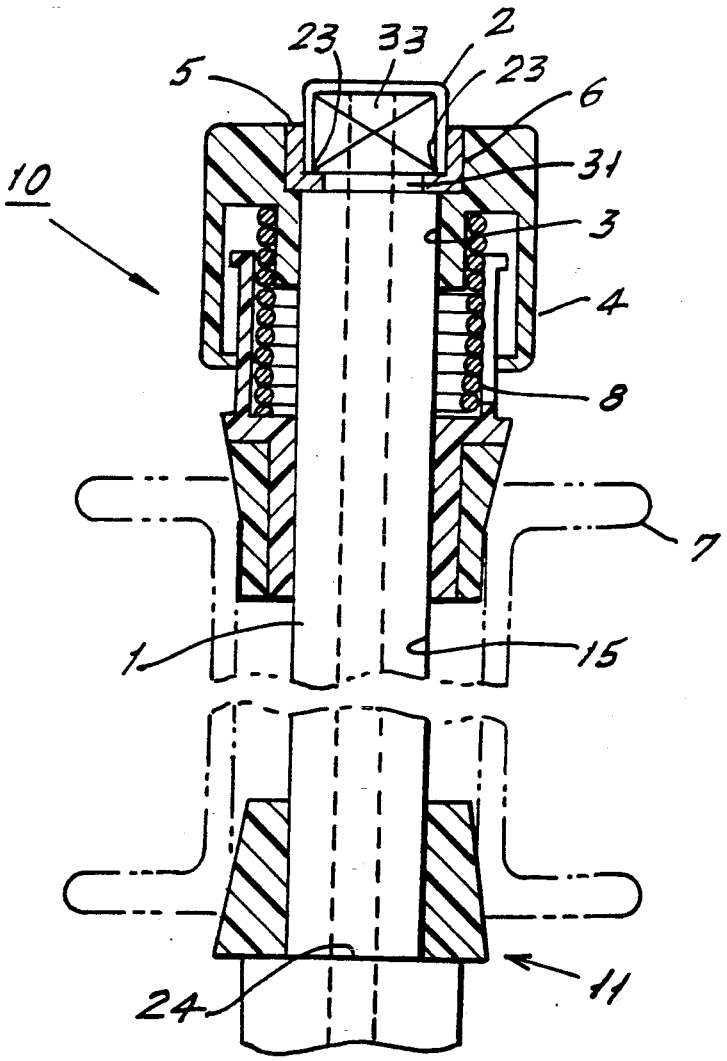
FIG. 1 is a cross section of the top part of a textile spindle and the spindle receiving adapter of the invention.

FIG. 1 shows the upper part of a textile spindle with a bobbin receiving and retaining means 10, 11 on it. A textile spindle 1 is usually non-removably held on a textile thread using machine, not shown. The spindle 1 receives a removable bobbin 7, which spins with the spindle.

A removable upper adapter unit 10 includes an upper adapter 4 around the top of the spindle 1. An upper conical receiver 9 is movably attached to and extends below the upper adapter 4 and tapers narrower downward toward the bobbin 7. The tapered end of the receiver 9 engages into the top end of the opening is in the hollow bobbin 7. Coiled spring 8 seated between the adapter 4 and the conical receiver 9 biases the conical receiver into the bobbin opening 15. The upper conical receiver 9 is tapered narrower downwardly to adapt its shape to various width bobbin openings and to enable it to be securely wedged into the bobbin opening.

There is a rectangular or double flat top part at the upper end of the spindle 1, which has two parallel, flat, opposite surfaces 33, 34. The top part 2 is movable into and out of the two intersecting, correspondingly shaped openings 21, 22 in a part 31 that is permanently anchored into the top 5 of the adapter 4 aligned with circular vertical passage 3 through adapter 4. The entire length of opening 21 extends through part 31 for the full depth thereof. Only the central portion of opening 22 extends through part 31 for the full depth thereof. Ledges 23 at each end of opening 22 limit the depth of opening 22 at these regions and provide seats for supporting the ends of top part 2 in the holding position of FIG. 1. Effectively, opening 22 is a recess that receives part 2 and holds same so unit 10 is held against rotation with respect to spindle 1 in that the sidewalls which define recess 22 are adjacent to and confront the two flat side surfaces 33, 34 of top part 2 of spindle 1. Thus, in this holding position the ends of top part 2 are disposed in shallow recess having a broken bottom wall that is defined by seats 23.

To dismount unit 10 from spindle 1 upper adapter 4 is moved downward against the force exerted by spring 8 until the bottom of part 2 is above upper surface 5 of adapter 4. Then the latter is pivoted a quarter turn from its positioned of FIG. 2 until part 2 and opening 21 are aligned. Now adapter unit 10 is free to be lifted upward clear of spindle 10.

When part 2 is aligned with opening 22, upward movement of adapter 4 is limited by engagement of seats 23 with part 2. Now force exerted by spring 8 presses down on the conical receiver 9.

The bobbin 7 rests on the lower conical receiver or adapter 11 that is seated on spindle ledge 24. Adapter 11 is tapered narrower upwardly so that its narrowed end may be received into the bottom of central passage 15 through the hollow bobbin 7. The lower adapter 11 is firmly installed on the spindle 1 and spring 8 presses the bottom 7 down firmly in place on the lower conical receiver 11.

Figure 2:
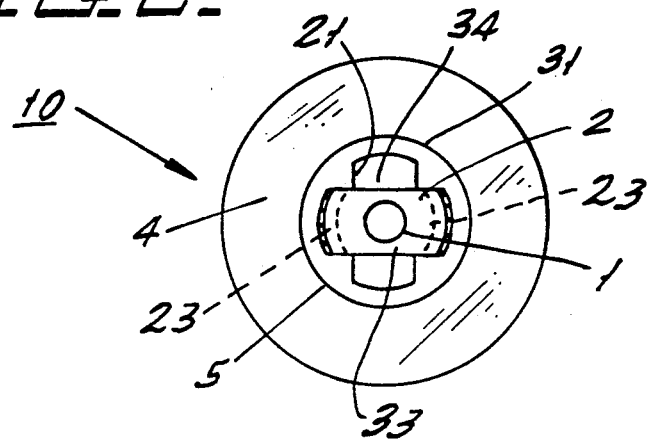
FIG. 2 is the top view of the removable adapter with the bayonet type bobbin lock mounted to a spindle.
Figure 2A:
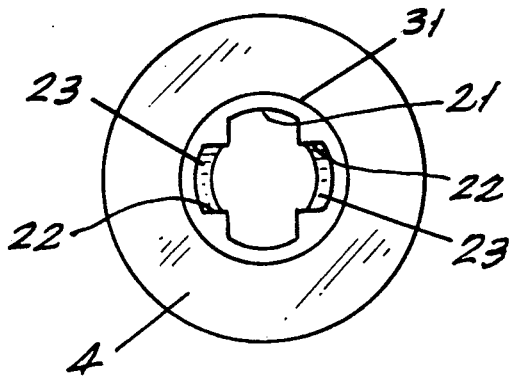
FIG. 2A is a top view of the removable adapter of FIG. 2 when each adapter is dismounted from the bobbin supporting spindle.

FIGS. 2 and 2A show the bayonet type lock of the removable adapter unit 10 in top view. In FIG. 2 the spindle 1 with its double flat surface top part 2 is shown in an operating position, i.e., held, in the recess provided by opening 22 of the adapter 4, which has the, two intersection openings 21, 22.

Figure 3:
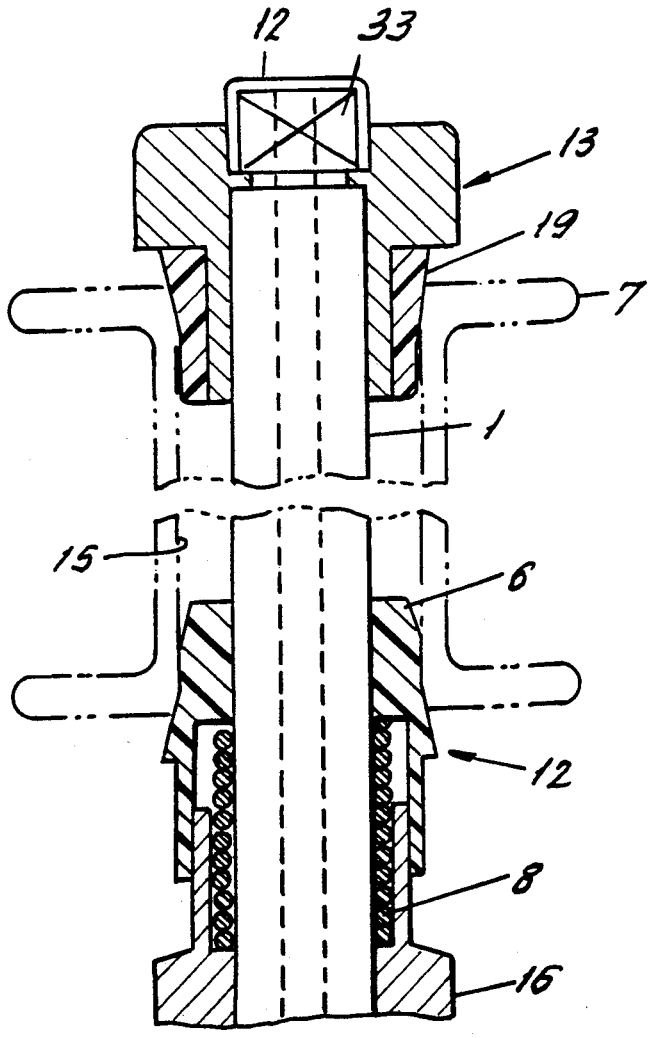
FIG. 3 shows the top part of a textile spindle with a spring element in the lower adapter.

In the embodiment shown in FIG. 3, the spring 8 is arranged in the lower part on the spindle, making that part a lower adapter 12, rather than the spring being disposed in the upper adapter 13 in FIG. 3. The upper adapter 13 is removable from the top of the spindle 1, together with its conical receiver portion 19 that is held stationary with respect to the remainder of upper adapter 13. In FIG. 3, the conical receiver 6 of the lower adapter 12 is installed for axial movement on the spindle core 1, and that conical receiver 6 is not firmly held on the spindle 1, as it is in the first embodiment. The bottom part 16 of the lower adapter is fixed on the spindle. The spring 8, therefore, biases the conical receiver 6 of the lower adapter 12 up into the bobbin opening 15.

The removable upper adapter 13 is developed integral with its bayonet form receiving openings 21, 22 for the top 2 of the spindle 1. Upper conical receiver 19 at the bottom of adapter 13 engages the bobbin opening 15, and limits the upward motion of the bobbin 7 under the bias of the spring 8 acting from below.

The conical shaped of the conical receiver 9, 11 and 6, 19 adapts them to the normal variations in the sizes of the bobbin openings 15 and enables them to be securely wedged into the bobbin openings 15 thereby to securely hold the bobbin 7 in place.

Although the present invention has been described in relation to particular embodiments thereof, many other variations and modifications and other uses will become apparent to those skilled in the art. It is preferred, therefore, that the present invention be limited not by the specific disclosures herein, but only by the appended claims.

What is claimed:

1. Apparatus for removable mounting of a bobbin to a spindle of textile machinery, said apparatus including;

an upper adapter and a lower adapter having respective upper and lower tapered parts entered into recess means at respective upper and lower ends of a bobbin mounted on a vertical spindle, said upper and lower tapered parts tapering outward in respective upward and downward directions;

first means for preventing rotation of said upper adapter with respect to said spindle on which the bobbin is mounted, said first means including a first section on said upper adapter and a second section on said spindle at its upper end, said first and second sections being mounted for selective pivotal movement relative to each other about a vertical axis between first and second angular positions;

said first means including a first section on said spindle at its upper end and a second section on said upper adapter, said first section including a horizontally elongated part, said second section including a recess that is elongated horizontally and is open at an upper surface of said upper adapter to receive said horizontally elongated part when said first and second sections are in said first angular position, and seating means in said recess to engage said horizontally elongated part and limit downward movement thereof into said recess;

said upper adapter having a vertical passage including an upper aperture that communicates with said recess, said upper aperture being elongated horizontally and being angularly disposed relative to said recess to permit said horizontally elongated part to enter said vertical passage through said upper aperture and pass through said vertical passage when said first and second sections are in said second angular position;

spring means operatively positioned when said first and second sections are in said first angular position to generate a force that is directed to urge said horizontally elongated part downward against said seating means, to urge said upper tapered part downward and to urge said lower tapered part upward.

2. The apparatus of claim 1, wherein the first means comprises double flat surfaces of said horizontally elongated part, surfaces of the upper adapter which define said recess being substantially a reverse form of the double flat surface, such that the double flat surfaces may be seated in the recess of the upper adapter through turning of the upper adapter with respect to the spindle until the recess in the adapter and the upper part of the spindle are in alignment by being in said first position with their matching shapes enabling the horizontally elongated part of the spindle to be received in the recess of the upper adapter.

3. The apparatus of claim 2, wherein said vertical passage below said aperture is larger than the recess and is larger than the aperture;

a separate piece including said upper tapered part movably mounted on said upper adapter and being entered into the vertical passage at the bottom thereof; said separate piece having a passage aligned with the vertical passage and extending therebelow.

4. The apparatus of claim 1, wherein said vertical passage below said aperture is larger than the recess and is larger than the aperture;

a separate piece including said upper tapered part mounted on said upper adapter for vertical movement relative thereto and being entered into the vertical passage at the bottom thereof; said separate piece having a passage aligned with the vertical passage and extending therebelow;

said spring means comprising a coiled element through which said spindle extends;

said spring means being partially compressed vertically by having said upper adapter bear against said spring means at its upper end and by having said separate piece bear against said spring means at its lower end.

5. The apparatus of claim 4 in which the lower tapered part is fixed vertically with respect to the lower adapter.

6. The apparatus of claim 1 in which the spring means comprises a coiled element through which said spindle extends;

said lower tapered part being movably vertically relative to said lower adapter;

said spring means being partially compressed vertically by having said lower adapter bear against said spring means at its lower end and by having said tapered part bear against said spring means at its upper end.

7. The apparatus of claim 6 in which the upper tapered part is fixed vertically with respect to the upper adapter.

8. The apparatus of claim 7, wherein the first means comprises double flat surfaces of said horizontally elongated part, surfaces of the upper adapter which define said recess being substantially a reverse form of the double flat surface, such that the double flat surfaces may be seated in the recess of the upper adapter through turning of the upper adapter with respect to the spindle until the recess in the adapter and the upper part of the spindle are in alignment by being in said first position with their matching shapes enabling the horizontally elongated part of the spindle to be received in the recess of the upper adapter.

* * * * *